US006007086A

United States Patent [19]

Hopkins

[11] Patent Number: 6,007,086

[45] Date of Patent: Dec. 28, 1999

[54] ELECTRIC SKI BINDING SYSTEM

[76] Inventor: Mark D. Hopkins, 3252 American Saddler Dr., Park City, Utah 84060

[21] Appl. No.: 09/062,234

[22] Filed: Apr. 17, 1998

Related U.S. Application Data

[60] Provisional application No. 60/044,614, Apr. 18, 1997.

[51] Int. Cl.[6] ..... A63C 9/08

[52] U.S. Cl. ..... 280/612; 280/613; 280/632; 292/251.5

[58] Field of Search ..... 280/612, 611, 280/613, 632, 623, 615; 307/119; 310/339; 292/251.5, 144

[56] References Cited

U.S. PATENT DOCUMENTS

| | | | |
|---|---|---|---|
| 3,318,610 | 5/1967 | Kulick | 280/11.35 |
| 3,667,771 | 6/1972 | Larson | 280/11.35 M |
| 3,814,454 | 6/1974 | Beyl | 280/11.35 C |
| 3,819,199 | 6/1974 | Smolka et al. | 280/11.35 M |
| 3,927,897 | 12/1975 | Olsen et al. | 280/612 |
| 3,960,383 | 6/1976 | O'Neil | 280/612 |
| 4,004,824 | 1/1977 | Svoboda | 280/636 |
| 4,402,524 | 9/1983 | D'Antonio et al. | 280/612 |
| 4,460,195 | 7/1984 | Bildner | 280/612 |
| 4,465,294 | 8/1984 | Spitaler et al. | 280/612 |
| 4,484,761 | 11/1984 | Knabel et al. | 280/612 |
| 4,494,768 | 1/1985 | Hull | 280/612 |
| 4,563,021 | 1/1986 | Klubitschko | 280/612 |
| 4,576,396 | 3/1986 | Stempfhuber | 280/612 |
| 4,851,706 | 7/1989 | D'Antonio | 307/119 |
| 5,051,605 | 9/1991 | D'Antonio et al. | 307/116 |
| 5,150,913 | 9/1992 | Hoelzl | 280/612 |
| 5,188,387 | 2/1993 | Ruffinengo | 280/612 |
| 5,294,144 | 3/1994 | Stepanek et al. | 280/612 |
| 5,498,017 | 3/1996 | Rohrmoser | 280/612 X |

*Primary Examiner*—Lanna Mai
*Assistant Examiner*—Hau V Phan
*Attorney, Agent, or Firm*—Madson & Metcalf

[57] ABSTRACT

An electric ski binding system with magnetic interfaces and a microprocessor achieves releasable engagement of a ski boot to ski bindings. A permanent magnet in the front ski binding and a permanent magnet of opposite polarity in the toe portion of the boot create a front magnetic interface. A permanent magnet in the rear ski binding and a permanent magnet of opposite polarity in the heel portion of the boot create a rear magnetic interface. Electromagnets in the proximity of the front and rear magnetic interfaces are disposed so that their polarity opposes the permanent magnets of the boot. The electromagnets are turned off while the boot is engaged with the ski binding to allow the permanent magnets to couple at the front and rear magnetic interfaces. The electromagnets are operated when disengaging the boot from the ski binding to create a magnetic field substantially greater than that of the permanent magnets in the front and rear magnetic interfaces.

Sensors are placed on the ski bindings to sense pressure and stress. The sensors relay signals indicative of applied pressure and stress to the microprocessor. The microprocessor evaluates the relayed signals to determine if an established threshold value is exceeded which is indicative of a release situation. In a release situation, the microprocessor effects operation of the front and rear electromagnets to repulse the boot from the ski bindings.

20 Claims, 7 Drawing Sheets

ELECTRIC SKI BINDING SYSTEM

RELATED APPLICATIONS

This application claims the benefit of U.S. Provisional Application No. 60/044,614 filed Apr. 18, 1997.

BACKGROUND

1. The Field of the Invention

The invention relates to an electromagnetic ski binding system. More specifically, the invention is directed towards an electromagnetic ski binding system with magnetic coupling and computer controlled magnetic release.

2. The Background Art

Ski bindings serve to releasably engage a skier's boot to a ski and provide a secure interface between boot and ski. Ski bindings further serve to release the boot from the ski when a potential injury situation occurs to thereby reduce injury to the skier. Ski bindings typically comprise a front and rear binding to secure the respective front and rear portions of the boot.

Conventional mechanical ski bindings incorporate mechanical components such as a clamping mechanism to secure the boot to the ski. Such mechanical ski bindings are designed to release when sufficient stress is applied to the binding as would be experienced in a potential injury situation. The amount of stress which effects release of the mechanical ski binding is adjustable to accommodate the experience and weight of the skier, terrain, and other conditions.

However, the mechanical ski bindings are limited in that they fail to release in a number of potential injury situations. In order for the mechanical ski bindings to release, the stress must be applied directly to the front ski binding or in the same plane as the ski. Often, stress applied to the rear binding or various torques applied to the boot and ski will fail to cause the bindings to release. Furthermore, when the mechanical ski bindings do release, the mechanical operation of the binding is sometimes not quick enough to avoid injury to the skier. Mechanical ski bindings are also heavy and include several moving parts making them unreliable and susceptible to breaking. Mechanical ski bindings may also fail to release if dirt, ice or snow impedes their performance. In addition, proper adjustment in the stress release of the mechanical ski bindings is sometimes difficult which can result in overly sensitive or overly resistive bindings. Finally, skiing is a cold weather sport and colder temperatures result in reduced performance of mechanical components.

Previous electric ski binding systems have been developed which utilize various electromagnetic, electronic, and electromechanical components. However, these ski binding systems are limited in that they incorporate various mechanical components and thereby include many of the previously described limitations of mechanical components. Thus, they do not always provide a quick enough release, are prone to failure, and can be difficult to adjust.

A further limitation on all previous ski bindings is that they fail to release during certain potential injury situations. As mentioned previously, certain tensions and torques applied to the ski and boot do not effect a release of the binding when a potential injury situation is clearly imminent. Furthermore, certain body positions and certain ski positions signal a potential injury situation, but conventional ski bindings will not be responsive to these positions and will not release.

From the foregoing it will be appreciated that it would be an advancement in the art to provide an improved ski binding system which would provide release response to a broader range of potential injury situations.

It would be a further advancement in the art to provide a ski binding system which allows a nearly instantaneous release of the boot from the binding to avoid undue injury.

It would also be an advancement in the art to provide a ski binding system which was more reliable, reduced the number of working parts, and allowed for accurate yet flexible adjustment specific to the skier.

Such a device is disclosed and claimed herein.

BRIEF SUMMARY

The invention provides an electronic ski binding system with magnetic interfaces to achieve releasable engagement of the boot to the binding and a microprocessor to control the releasable engagement. The invention comprises a front magnetic interface with a permanent magnet in the front ski binding and a permanent magnet of opposite polarity in the toe portion of the boot. Similarly, the invention further comprises a rear magnetic interface with a permanent magnet in the rear ski binding and a permanent magnet of opposite polarity in the heel portion of the boot. The front and rear magnetic interfaces have magnetic fields of sufficient strength to ensure engagement of the boot to the ski binding during normal ski conditions. Accordingly, engagement of the boot to the ski binding depends on the strength of the magnetic fields rather than mechanical means.

The invention further comprises electromagnets in the proximity of the front and rear magnetic interfaces. The electromagnets are disposed so that their polarity opposes the permanent magnets of the boot. The electromagnets are also in electric connection with a rechargeable power supply in the ski binding. The electromagnets are turned off while the boot is engaged with the ski binding which allows the permanent magnets to couple at the front and rear magnetic interfaces. To disengage the boot from the ski binding, the electromagnets are turned on briefly to create a magnetic field substantially greater than that of the permanent magnets in the front and rear magnetic interfaces. This results in a nearly instantaneous repulsion of the boot from the ski binding.

The combination of permanent magnets and electromagnets allows for ski bindings which nearly eliminates the need for any moving, mechanical parts. Furthermore, although mechanical parts do not perform as well in cold weather, magnets experience better performance in colder weather.

The invention further comprises a series of sensors which are placed on the ski bindings to sense pressure and stress. These sensors are in electrical communication with the microprocessor and output electrical signals to the microprocessor to convey the status of applied pressure and stress to the bindings. In one presently preferred embodiment, the sensors are placed in the front and rear bindings and to the left and right of the boot. The combination of sensors are able to more accurately reflect the pressure and stress that the boot is subject to than conventional mechanical ski bindings.

In one embodiment, a transmitter is placed in the forward portion of one ski and a receiver is placed in the forward portion of the other ski. The transmitter and receiver act in conjunction to indicate the relative position of the skis with respect to one another. Thus, a potential injury situation would be indicated if the skis become crossed or to far spread from one another. The receiver is in electrical communication with the microprocessor and sends signals to the microprocessor which conveys the relative position of the skis.

In another embodiment, transmitters are fixed to different locations of the skier's body. For example, the transmitters would be placed in each limb of the skier. A receiver is fixed approximately in the torso of the skier. The transmitters and receiver act to indicate the relative position of the body. The receiver is in electrical communication with the microprocessor and sends signals indicating the position of the transmitters and receivers. If the receiver loses contact with the transmitters, this would indicate that the limbs are inappropriately positioned relative to the body and a potential injury is imminent.

The microprocessor may be located in either the ski bindings or the boot and is in electrical communication with the electromagnets to control their operation. The microprocessor is also in electrical communication with the sensors and receivers as previously mentioned. The microprocessor comprises a memory such as an EPROM and is programmed to process incoming signals from the sensors and the receivers. Based on its programmed parameters, the microprocessor determines if the skier is in a potential injury situation. The programmed parameters are based on a variety of possible factors including the skier's ability, the skier's weight, the terrain, the weather conditions, and so forth. Thus, if the signals from the sensors transmit data which exceeds a programmed threshold, a potential injury is indicated. Alternatively, the receivers may signal a body position which indicates that a potential injury situation is imminent. In a potential injury situation, the microprocessor activates the electromagnets which results in the nearly instantaneous release of the boot from the ski bindings, thereby preventing the injury.

A manual release is also provided and is in electrical communication with the microprocessor and signals the microprocessor to release the ski bindings. The skier may toggle the manual release when removal of the boot from the ski binding is desired.

Thus, it is an object of the invention to provide an electronic ski binding system which eliminates nearly all moving parts thereby provides nearly instantaneous, reliable release of the boot from the ski binding in potential injury situations.

It is a further object of the invention to provide an electronic ski binding system which releases based on programmable parameters which reflect a broad range of potential injury situations.

It is another object of the invention to enable individuals the ability to customize individual parameters which effect release of the ski bindings.

It is yet another object of the invention to provide an electronic ski binding system which provides superior performance in colder temperatures.

These advantages and others of the present invention will become more fully apparent by examination of the following description of the preferred embodiments and the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide selected embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
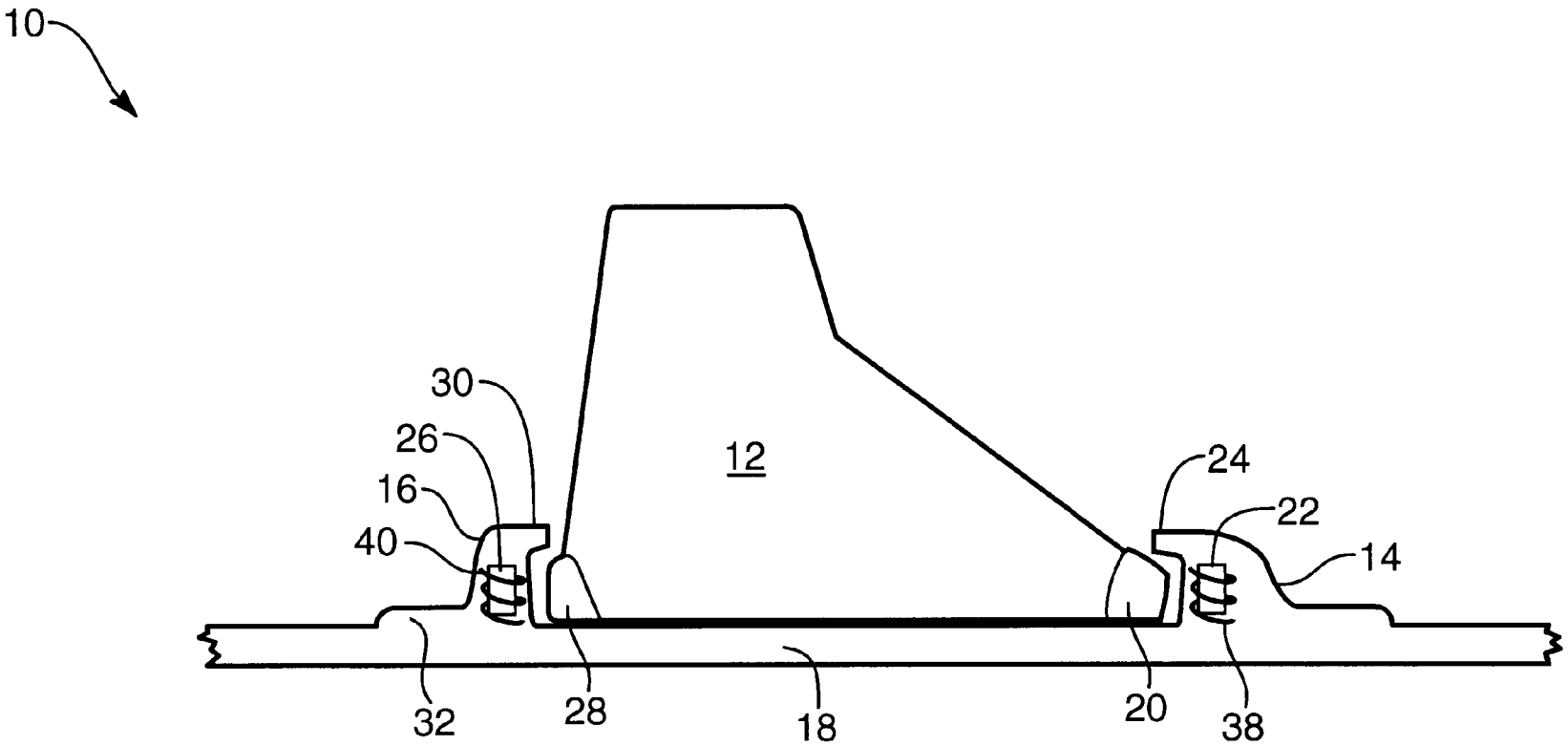
FIG. 1 is a side view of the ski boot in position with the ski bindings.

Reference is now made to the embodiments and methods illustrated in FIGS. 1 through 4. With reference to FIG. 1 there is shown a side view of the electric ski binding system 10. The electric ski binding system 10 as shown comprises a boot 12 and front ski and rear ski bindings 14, 16. The front and rear ski bindings 14, 16 are mounted to a conventional ski 18. The boot 12 comprises a toe permanent magnet 20 in the toe portion of the boot 12. The front ski binding 14 comprises a front permanent magnet 22 and is configured to conform to the toe portion of the boot 12. When the boot 12 is inserted into the ski bindings 14, 16 a front magnetic interface is created by the front permanent magnet 22 in the front ski binding 14 and the toe permanent magnet 20 in the toe portion of the boot 12. The permanent magnets 20, 22 are positioned so that opposing poles are facing one another during use to create an attractive magnetic field when in proximity to one another.

In one presently preferred embodiment, the front ski binding 14 has a ledge 24 which protrudes slightly rearward so that the toe of the boot fits under the ledge 24 in use. The ledge 24 may be primarily composed of the front permanent magnet 22 to provide additional surface area to ensure a stronger front magnetic interface between the front permanent magnet 22 and the toe permanent magnet 20. The ledge 24 also facilitates guidance of the boot 12 into the front binding 14. The magnetic field of the front magnetic interface is of sufficient strength to secure the toe of the boot 12 to the front binding 14 during normal use.

The invention further comprises a rear permanent magnet 26 in the rear binding 16 and a heel permanent magnet 28 in the heel portion of the boot 12. As with the front binding 14, the permanent magnets 26, 28 are located so that their opposing poles are placed in proximity to one another during normal use to create an attractive magnetic field. In one presently preferred embodiment, the rear binding 16 has a ledge 30 slightly protruding forward over the heel permanent magnet 28 to further secure the heel to the rear binding 16. The magnetic field of the rear magnetic interface is also of sufficient strength to secure the heel of the boot to the rear binding 16 during normal use.

In one presently preferred embodiment, the rear binding 16 is placed on a slidable track 32 to allow the rear binding 16 to move slightly forward and rearward along the length of the ski 18. Preferably, the rear binding 16 will be positioned rearward approximately ½ to ¾ of an inch before the boot 12 is inserted into the bindings 14, 16. This allows the boot 12 to be inserted between the front and rear bindings 14, 16. After insertion, the rear binding 16 slides forward to engage the heel portion of the boot 12 in a rear magnetic interface.

Figure 2A:
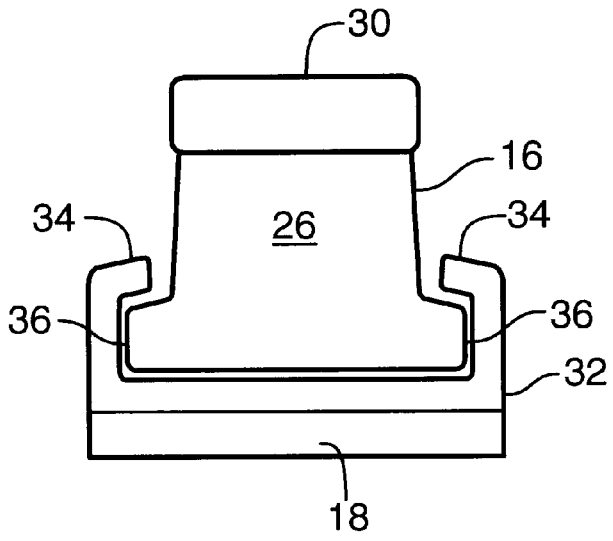
FIG. 2*a* is a front view of the rear ski binding on a slidable track.
Figure 2B:
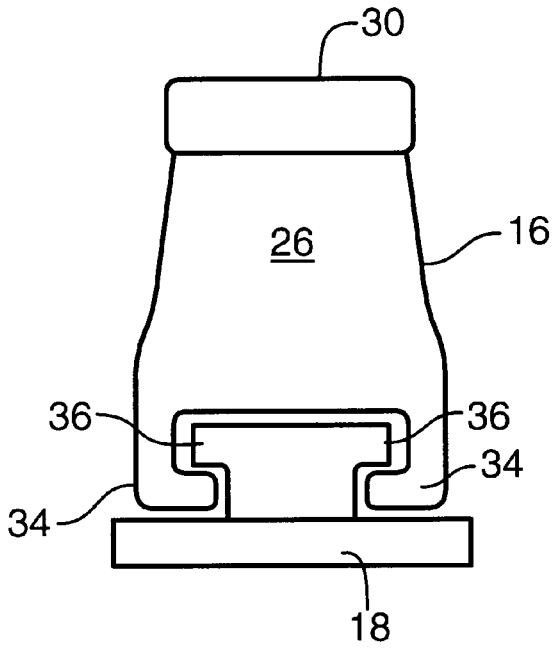
FIG. 2*b* is a front view of an alternative embodiment of the rear ski binding on a slidable track.

With reference to FIGS. 2A and 2B possible embodiments for the sliding track 32 are shown. In both embodiments, the sliding track 32 and the rear ski binding 16 are configured to interlock proximate with one another to accommodate slidable movement along the length of the ski 18. In the embodiment of FIG. 2A the slidable track 32 is configured with guide tracks 34 which extend around the rear ski binding 16 as shown. The rear ski binding 16 is configured with protrusions 36 to prevent removal of the rear ski binding 16. The guide tracks 34 and the protrusions 36 maintain the proximate positioning of the rear ski binding 16 to the slidable track 32.

In the embodiment of FIG. 2B the rear ski binding 16 is configured with guide tracks 34 which extend around the slidable track 32. The slidable track 32 is configured with protrusions 36 to provide an interlocking connection with the guide tracks 34 and maintain the proximate positioning of the slidable track 32 and the rear ski binding 16.

In one embodiment, the slidable track 32 is coated with a TEFLON layer or other low friction material where it interfaces with the rear ski binding 16 to facilitate sliding.

In an alternative embodiment, a first sliding permanent magnet is disposed on the bottom surface of the rear ski binding 16. A second sliding permanent magnet is disposed on the top surface of the sliding track 32 such that it has the same polarity facing the first sliding permanent magnet to create a repulsive magnetic field. The guide tracks 34 secure the rear ski binding 16 to the slidable track 32 to maintain the first sliding permanent magnet proximate to the second sliding permanent magnet such that the rear ski binding 16 is slightly levitated. The guide track 34 allows slidable movement of the rear ski binding 16 forward and rearward along the slidable track 32. In this manner, nearly frictionless movement of the rear binding 16 is achieved based on the repulsing magnetic field of the first and second sliding permanent magnets.

The system 10 of the invention further comprises a front electromagnet 38 which is located proximate to the front magnetic interface. In one presently preferred embodiment, the front electromagnet 38 is located in the front binding 14, but in alternative embodiments it may be located in the toe portion of the boot 12. The front electromagnet 38 is turned off while the boot 12 is secured to the front binding 14. However, when the front electromagnet 38 is turned on, the front electromagnet 38 creates a magnetic field which repulses the toe permanent magnet 20 of the boot 12 from the front binding 14. Thus, the front magnetic interface is reversed from an attractive field to a repulsive field instantaneously upon operation of the front electromagnet 38. The repulsive field forces the boot 12 rearward from the front binding 14.

In one embodiment the front electromagnet 38 comprises a wire coil which is disposed around the front permanent magnet 22 in the front binding 14. When operation of the front electromagnet 38 is desired, a current is sent through the wire coil which reverses the polarity of the front permanent magnet 22 and causes the front permanent magnet 22 to repulse the toe permanent magnet 20.

In an alternative embodiment, the front electromagnet 38 comprises one or more electromagnets adjacent the front permanent magnet 22. When the front electromagnet 38 is turned on, the one or more electromagnets create a repulsive magnetic field substantially stronger than the attractive magnetic field that exists between the front and toe permanent magnets 22, 20. This results in an instantaneous repulsion of the toe of the boot 12 from the front binding 14.

The invention of the system also comprises a rear electromagnet 40 which is located proximate to the rear magnetic interface. The rear electromagnet 40 operates to repulse the heel portion of the boot 12 from the rear binding 16. In one presently preferred embodiment the rear electromagnet 40 is located in the rear binding as shown in FIG. 1. However in alternative embodiments the rear electromagnet 40 may be located in the heel portion of the boot 12. As with the front electromagnet 38, the rear electromagnet 40 may be comprised of a wire coil disposed around the rear permanent magnet 26 or may be comprised of one or more independent electromagnets. Operation of the rear electromagnet 40 is similar to that of the front electromagnet 38.

The combination of permanent magnets 20, 22, 26, 28 and electromagnets 38, 40 allows for ski bindings 14, 16 which attract or repulse the ski boot 12 as desired. The system of the invention further eliminates most moving, mechanical parts. As mentioned previously, the strength of the attractive magnetic fields between the permanent magnets 20, 22, 26, 28 is sufficient to ensure coupling of the boot 12 to the bindings 14, 16 throughout normal use. The strength of the permanent magnets 20, 22, 26, 28 is based on the size and type of skis and boots. The strength of the front and rear electromagnets 38, 40 to achieve a repulsive magnetic field is determined by the strength of the permanent magnets 20, 22, 26, 28.

When the skier desires to insert the boot 12 into the bindings, the rear electromagnet 40 is turned on. This causes the rear binding 16 to move rearward from the heel of the boot 12 along the slidable track 32 to allow insertion of the boot 12 between the front and rear bindings 14, 16. Once the boot 12 is inserted between the front and rear bindings 14, 16 the rear electromagnet 40 is turned off. This causes the rear binding 16 to move forward and couple with the heel portion of the boot 12 in response to the attractive field of the rear and heel permanent magnets 26, 28. The toe portion of the boot 12 also couples with the front binding 14 in response to the attractive field of the toe and front permanent magnets 20, 22.

During skiing, the front and rear electromagnets 38, 40 remain off to allow secure coupling of the boot 12 to the front and rear bindings 14, 16. In normal use, the boot 12 is only released from the bindings 14, 16 through the use of electromagnetic fields. When the skier desires to remove the ski 18, the front and rear electromagnets 38, 40 are simultaneously turned on which causes the boot 12 to be nearly instantaneously repulsed from the front and rear ski bindings 14, 16. When the rear electromagnet 40 is turned on, the rear binding 16 slides rearward along the slidable track 32 which allows sufficient room for the boot 12 to be expelled from the bindings 14, 16.

The boot 12 is also repulsed from the ski bindings 14, 16 in a number of situations which correspond to a potential injury. This is explained in greater detail below.

Figure 3:
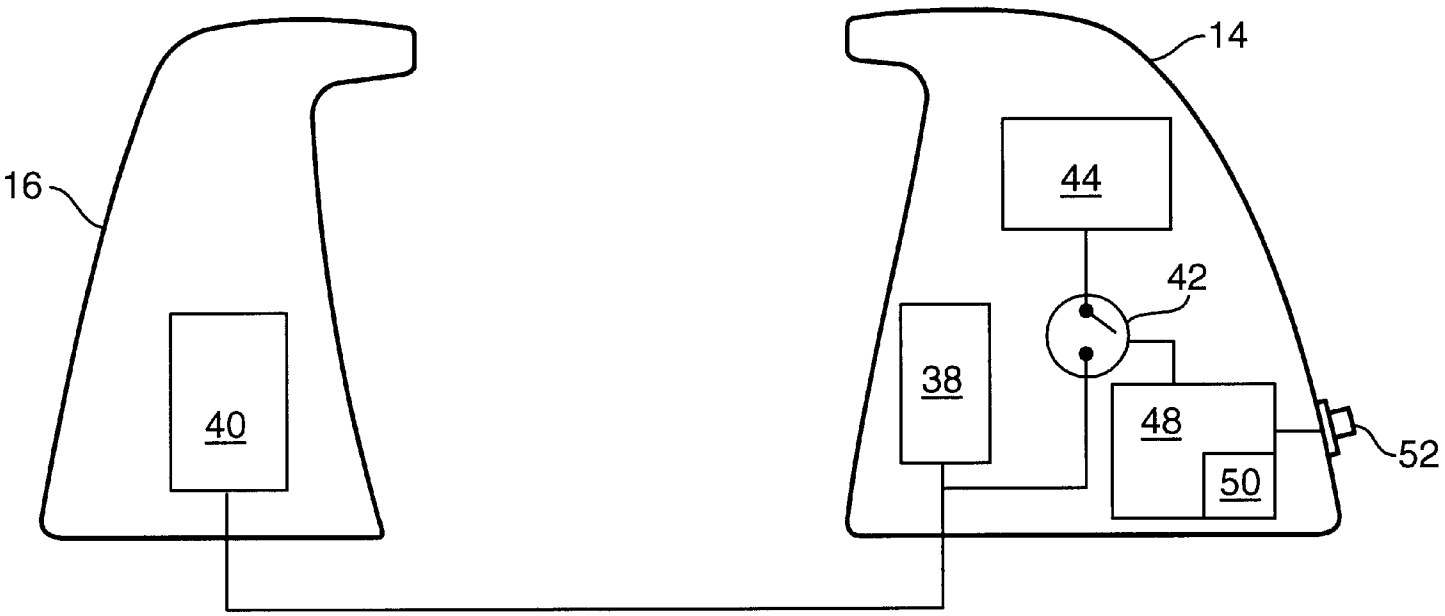
FIG. 3 is a block diagram of components contained in the front and rear ski bindings.

With reference to FIG. 3, the front and rear electromagnets 38, 40 are both in electrical communication with a switch 42 and a rechargeable power supply 44. The switch 42 as defined herein is any electrical device which controls the flow of power to the front and rear electromagnets 38, 40. Both the switch 42 and rechargeable power supply 44 are preferably located in the ski bindings 14, 16. The front and rear electromagnets 38, 40 need only be turned on for a fraction of a second in order to repulse the boot 12. Accordingly, a large amount of power is not needed from the power supply 44 for a release of the boot 12.

Figure 4:
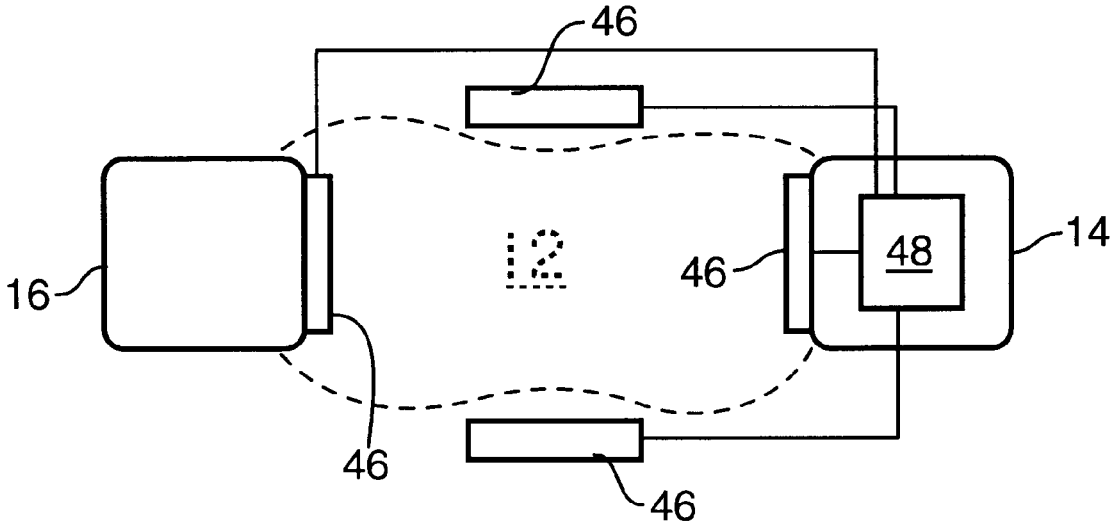
FIG. 4 is a block diagram of sensors placed in relationship with the front and rear ski bindings.

With reference to FIG. 4, the system 10 of the present invention is shown further comprising a series of sensors 46 which are placed on the ski bindings 14, 16 at different locations to sense pressure, stress, and torque. In one presently preferred embodiment, the sensors 46 are placed in the front and rear bindings 14, 16 and to the left and right of the boot 12. The sensors 46 may be embodied as piezoelectric transducers. In one embodiment as shown in FIG. 4, sensors 46 are positioned on the front and rear ledges 24, 30 of the respective front and rear ski bindings 14, 16. In order to register torque, a couple of sensors 46 are placed on top of one another at any one of the sensor locations. As the top and bottom sensors 46 move relative to one another, the torque experienced at that location may be transmitted. The sensors 46 provide a far superior response to the pressure and stress that the bindings 14, 16 and boot 12 are subject to than conventional mechanical ski bindings. Conventional ski bindings are unresponsive to previous pressure, stresses, and torques from various directions, but the sensors 46 are able to register such forces.

The sensors 46 are in electrical communication with a microprocessor 48 and output signals to the microprocessor 48 which represent the pressure, stress, and torque to which the bindings 14, 16 are being subjected to. The emitted signals from the sensors 46 are analog signals but are converted to digital signals before reaching the microprocessor 48.

In one presently preferred embodiment, the microprocessor 48 is located in the ski bindings 14, 16, however, in alternative embodiments the microprocessor 48 may be located in the boot 12. The microprocessor 48 is in electrical communication with the switch 42 and the front and rear electromagnets 38, 40 as well as the sensors 46. The microprocessor 48 comprises memory such as an EPROM 50 which is programmed to process incoming signals and, based on programmed parameters, determine if the boots 12 need to be released. The programmed parameters reflect a variety of factors which would be used to calculate the threshold for the amount of stress, pressure, or torque for the skier. Some of these factors can include the skier's ability and age, the skier's weight, the terrain, the weather conditions, snow conditions, and so forth.

The sensors 46 constantly transmit signals to the microprocessor 48 which reflect stress, pressure, and torque. The microprocessor 48 processes the signals and determines if the programmed threshold is reached which indicates a likely injury situation. Upon reaching the threshold, the microprocessor 48 toggles the switch 42 to simultaneously turn on both the front and rear electromagnets 38, 40. This results in the nearly instantaneous release of the boot 12 from the ski bindings 14, 16. In this manner, a release is achieved which is far quicker than that possible with bindings using mechanical components.

The microprocessor 48 is also in electrical communication with a manual release button 52. The manual release button 52 is preferably located on the bindings 14, 16 and is used by the skier when a release of the boot 12 is desired. The skier simply toggles the manual release button 52, the microprocessor 48 receives a corresponding signal, and then the microprocessor 48 activates the electromagnets 38, 40. All control of the release of the boot 12 is thus directed through the microprocessor 48.

The system 10 of the invention relies on a rechargeable power supply 44 which, in the preferred embodiment, is located on the bindings 14, 16. The power supply 44 is in electrical communication with and provides power to the sensors 46, microprocessor 48, and electromagnets 38, 40. The power supply 44 may be embodied as nicad or lithium batteries and when fully charged would have sufficient charge for several hours of normal skiing. One skilled in the art will appreciate that various embodiments for the power supply 44 are possible and are included within the scope of the invention.

Figure 5A:
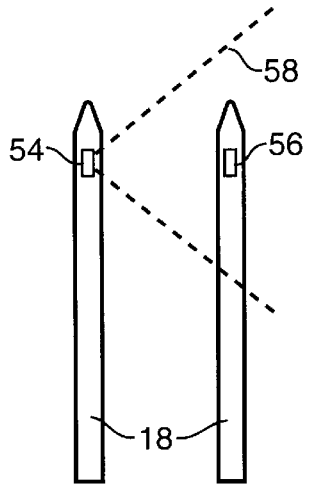
FIG. 5*a* is a plan view illustrating skis of the invention in a normal position.
Figure 5B:
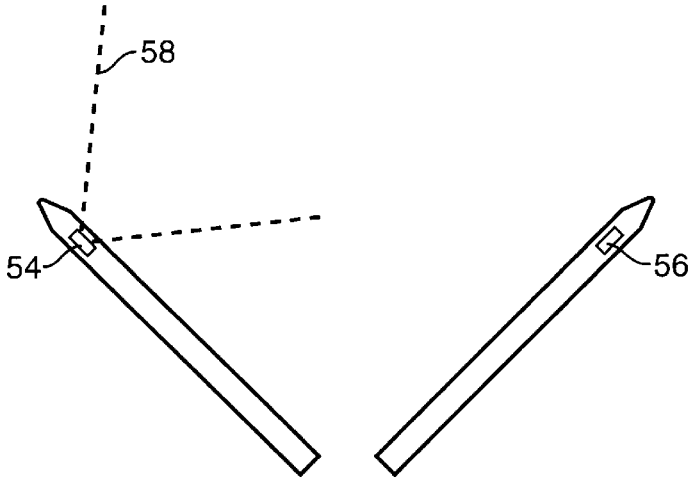
FIG. 5*b* is a plan view illustrating skis of the invention in a "split" position.
Figure 5C:
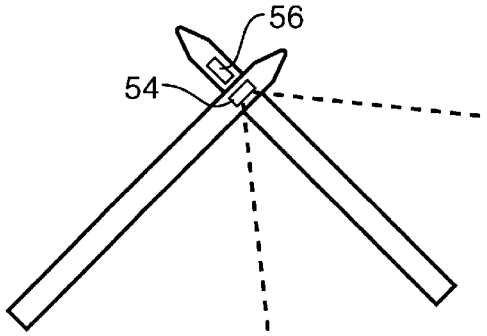
FIG. 5*c* is a plan view illustrating skis of the invention in a "crossed" position.

The system 10 of the invention may incorporate additional features to allow for microprocessor controlled release of the boot 12 based on additional input. With reference to FIGS. 5*a*, 5*b*, 5*c* a transmitter 54 is shown placed in the forward portion of one ski 18. The transmitter 54 transmits to a receiver 56 which is placed on the forward portion of the other ski. The transmitter signal is preferably digitally encoded to prevent communication with other ski receivers. The receiver 56 is in electrical communication with the microprocessor 48 to transmit a signal to the microprocessor 48 indicative of the communication between the receiver 56 and the transmitter 54. In this manner, the transmitter 54 and the receiver 56 act in conjunction to indicate the relative position of the skis 18 with respect to one another.

In one presently preferred embodiment, the continued communication of the transmitter 54 to the receiver 56 indicates a non-release situation. The transmitter 54 has a transmit arc 58 such that communication is enabled when the receiver 56 is within the range of the arc 58. When the receiver 56 is outside the arc, then communication between the transmitter 54 and receiver 56 is interrupted. Interruption of the communication indicates that a potential injury situation is imminent. The receiver 56 relays to the microprocessor 48 that the communication has been interrupted. The microprocessor 48 then sends a signal to the front and rear electromagnets 38, 40 to release the boot 12 from the bindings 14, 16.

FIGS. 5*a*, 5*b*, and 5*c* show series of ski positions which illustrate the communication of the transmitter 54 and receiver 56. In FIG. 5*a*, the skis are shown in a normal position wherein they are substantially parallel to one another. The transmission arc 58 is indicated in a dotted line and the transmitter 54 and receiver 56 are able to communicate without interruption. In FIG. 5*b*, a "split" position is shown wherein the front ends of the skis 18 are to far angled from one another. Such a position likely results in an injury. As shown, the transmission is interrupted and the microprocessor 48 would signal a release of the boots 12. In FIG. 5*c*, the skis 18 have become crossed and overlap one another. Such a position also likely indicates that an injury is imminent. As with FIG. 5*b*, the transmission is interrupted and the microprocessor 48 would signal the release of the boots 12.

In an alternative embodiment the transmitter and receiver communication may be more sophisticated so that the transmission relays the actual distance between the transmitter 54 and receiver 56. In such an embodiment, the microprocessor 48 signals a release of the boots 12 if the distance becomes too great or too little. The microprocessor 48 may also release the boot 12 if the transmission is interrupted completely as with the previous embodiment.

Figure 6:
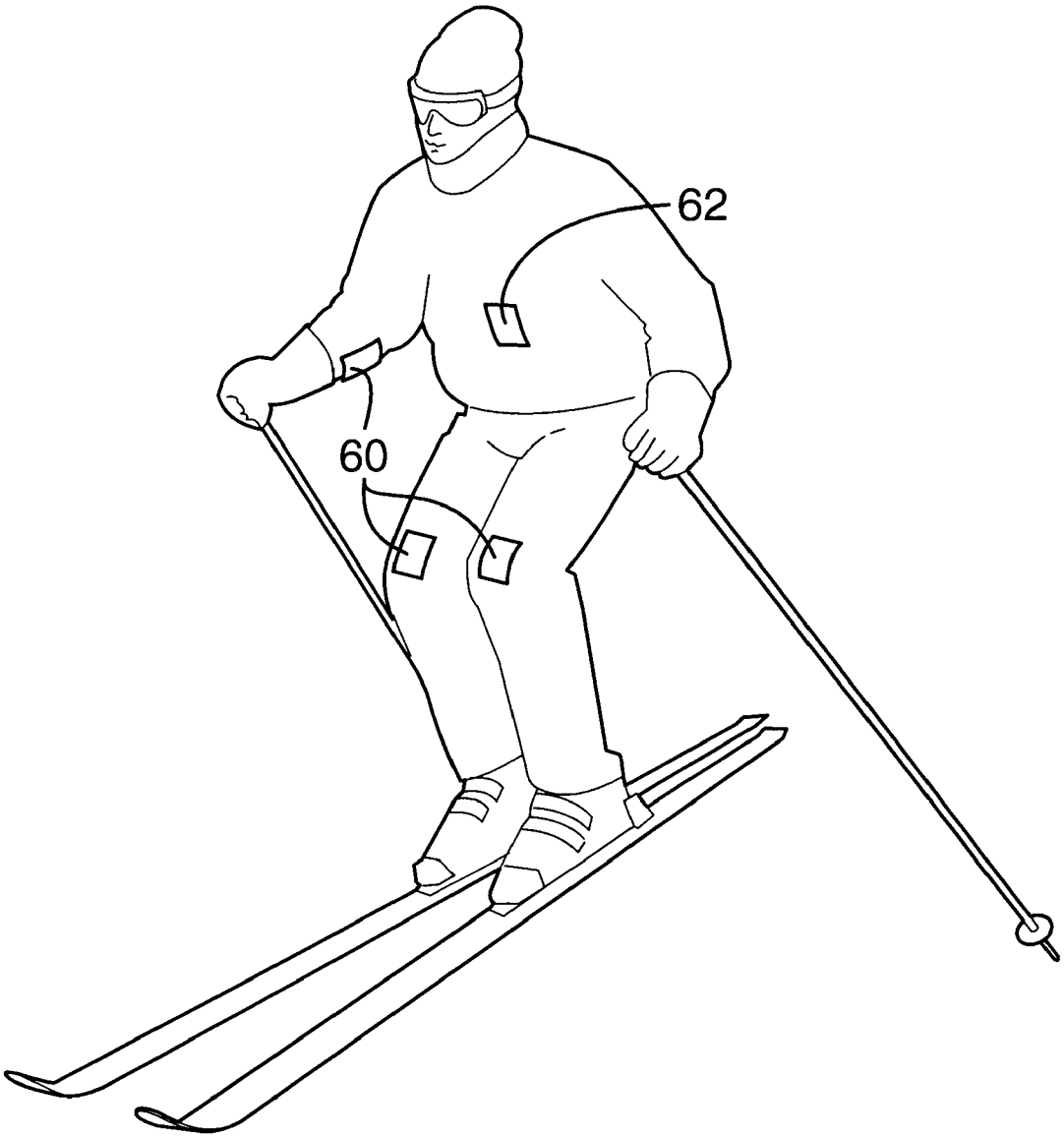
FIG. 6 is a perspective view of the skier equipped with one embodiment of the system of the invention.

With reference to FIG. 6, an additional feature which may be incorporated into the system of the present invention is shown which includes the use of transmitters 60 and a receiver 62 to indicate body position. This feature utilizes transmitters 60 which are fixed to different locations of the skier's body. In one presently preferred embodiment the transmitters 60 are placed on each limb of the skier. The positions of the transmitters 60 and receiver 62 are generally shown as they would be disposed in one presently preferred embodiment. In one embodiment, transmitters 60 are attached to each knee and to each forearm of the skier. A receiver 62 is fixed onto the torso of the skier at approximately the center of gravity of the skier. The positions of the transmitters 60 and receiver 62 represent only one possibility and one skilled in the art will appreciate that a variety of dispositions are possible and are included within the scope of the invention.

Preferably, the transmitters 60 transmit a digitally encoded signal so as to prevent interference with other skiers or ski equipment. The receiver 62 is in electrical communication with the microprocessor 48 and send signals indicating the communication between the transmitters 60 and receiver 62.

In one presently preferred embodiment, the transmitters 60 have a directed transmission arc. Knee transmitters 60 are generally directed upwards towards the torso and forearm transmitters 60 are generally directed towards the torso. The transmission to the receiver 62 is interrupted when the receiver 62 is outside the transmission arc. In the normal course of skiing, the receiver 62 remains within the transmission arc of each transmitter 60. If one or more transmitters 60 breaks contact with the receiver 62, then the limbs are in a position that indicates an injury position is likely. One example of this is when the skier's hips are below the knees. Another example of this is when the arms are behind the back. When the transmission is interrupted, the receiver 62 relays this to the microprocessor 48 which in turn signals the release of the boots 12.

The transmitters 60 on the knees and forearms may be digitally encoded differently so that the microprocessor 48 can distinguish between each transmitter 60. Thus, the microprocessor 48 is informed as to which limb or limbs are out of normal skiing position. The microprocessor 48 may then be programmed to release the boots 12 based on limb positions. For example, interruption of transmission of one forearm transmitter 60 does not signal a release, however, interruption of both forearm transmitters 60 does signal a release. Similar programming may be available for the knee transmitters 60 as well.

In an alternative embodiment of the body position feature, a transmitter 60 is disposed on the torso of the skier. As before, the transmission is preferably digitally encoded to prevent interference with other skiers and ski equipment. Receivers 62 are disposed approximately on each forearm and on each knee. The transmitter 60 has a transmission arc of approximately 180 degrees and is directed forward from the skier. Thus, when the knees and forearms are forward of the torso, the transmission continues uninterrupted. When the knees or forearms extend behind the torso, the transmission is interrupted and a release is signaled.

In embodiments which incorporate the ski position and body position release features, interruption of the transmissions may occur when the skier is in a sitting position. This occurs, for example, when the skier is riding on the chairlift. Obviously, the skier does not want the boot 12 to release during this time. Accordingly, the microprocessor 48 may be programmed to disregard releases based on ski and body positions when the sensors 46 signal low pressures. Low pressures correspond to the situation where the skier is no longer placing substantially all of the skier's weight on the skis 18. Thus, when the skier is in a sitting position, release based on ski and body position is temporarily suspended.

Figure 7:
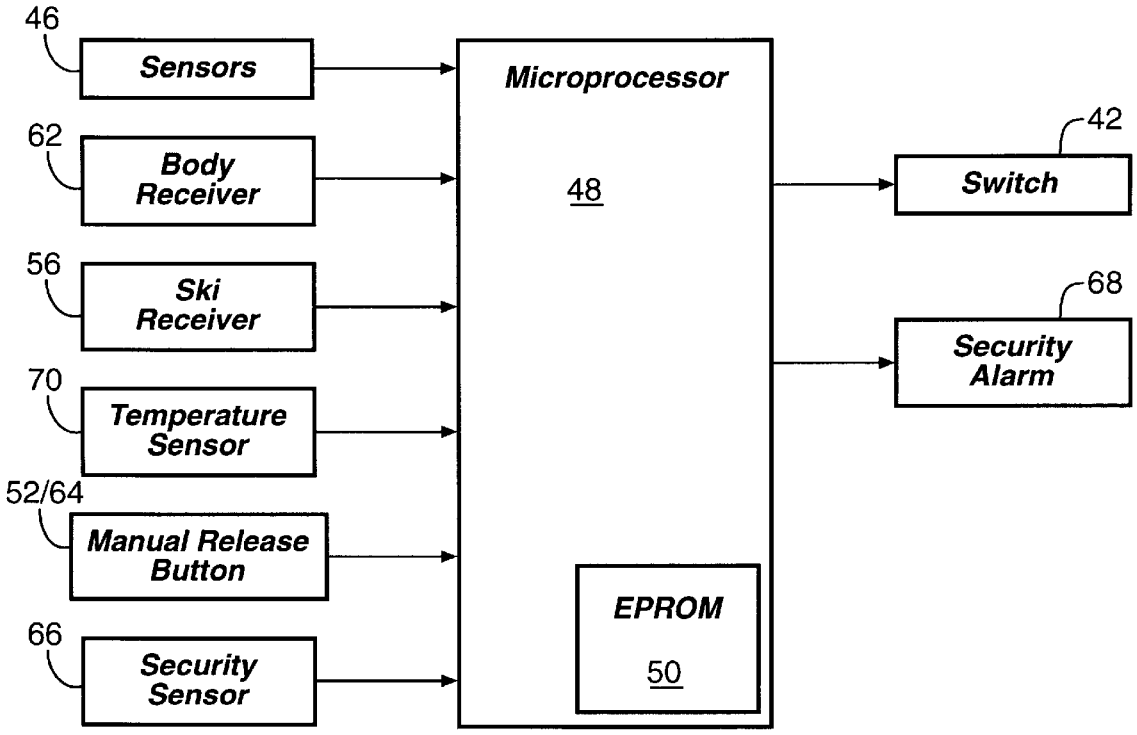
FIG. 7 is a block diagram of the microprocessor in electrical communication with sensor and receiver components.

With reference to FIG. 7, a block diagram illustrating the microprocessor 48, the sensors 46, and the receivers 62 of the invention are shown. The sensors 46 located on the ski bindings 14, 16 are preferably embodied as pressure transducers and generate an analog signal which is converted to a digital signal and is sent to the microprocessor 48. The microprocessor 48 processes these signals to determine if a threshold has been reached which signals release of the boot 12. Certain thresholds are established in the programming for the sensors 46 in the front binding 14, rear binding 16, and to each side of the boot 12. Thus, the threshold may be reached by substantial pressure, stress, or torque in one sensor 46 or with pressure, stress, or torque in a combination of sensors 16. As previously mentioned, the threshold for release is established by weighting factors representing the body weight of the skier, skier ability, ski conditions, age, ski type, boot type, gender, and so forth. The parameters for each factor may be programmed in the EPROM 50 prior to each ski trip to allow customization as desired.

The manual release button 52 is further illustrated in electrical communication with the microprocessor 48. Another possible embodiment of the system 10 of the present invention includes a pole manual release button 64 disposed on the ski pole. Preferably, the pole manual release button 64 is recessed on the ski pole, such as in the handle of the ski pole. This prevents accidental depression of the button during skiing. The pole manual release button 64 is in electrical communication with a transmitter also disposed on the pole. The transmitter transmits a digitally encoded signal to a receiver which is in electrical communication with the microprocessor 48. The receiver sends the signal to the microprocessor 48 which in turn releases the boots 12 from the bindings 14, 16. The receiver may be the same one disposed on the ski to relay ski position, may be one disposed on the skier's body to relay body position, or may be an additional receiver disposed on the bindings or body. The transmitter preferably has a spherical transmission so as to enable easy reception by the receiver.

An additional feature which may be incorporated into the system of the present invention is a security alarm. A motion sensor or other security sensor 66 is disposed on the skis 18 and is in electrical communication with the microprocessor 48. When the sensor 66 is activated, the microprocessor 48 signals an alarm 68 to sound. The owner deactivates the sensor 66 or alarm 68 by toggling a manual button which is in electrical communication with a transmitter. The transmitter sends a digitally encoded signal to a receiver disposed on the skis and in electrical communication with the microprocessor 48. The receiver sends a signal to the microprocessor 48 which in turn deactivates the sensor 66 or alarm 68. In a similar manner, the owner may activate the sensor 66 when leaving the skis so as to deter theft. The manual button and transmitter may be disposed on the ski pole, key chain, or other item carried by the owner.

A possible additional feature of the invention is a temperature sensor 70 disposed on the ski bindings 14, 16 and in electrical communication with the microprocessor 48. The temperature sensor 70 generates digital signals representative of the outside temperature. The signals are sent to the microprocessor 48. The microprocessor 48 factors the temperature as a weighting factor into its programmed algorithm for determining the threshold for release of the boot 12 from the bindings. If the system 10 uses a mechanical component, such as for the sliding track 32 of the rear binding 16, then the temperature effects the timing of the release. In colder weather, a lower threshold for quicker release is desired to compensate for the delay of the mechanical component. Alternatively, in warmer weather, a higher threshold is permissible because of the reduced delay.

Additional inputs to the microprocessor 48 include digitally encoded signals from the receivers 46, 62 which correspond to the ski positions and body position of the skier. These inputs indicate an interruption of transmission, and the microprocessor 48 is programmed to effect release upon interruption of one or more of the transmissions. Thus, the processing of the receiver signals does not consider the threshold value which is established for skier customization factors.

Each ski 18 preferably has its own microprocessor 48. Thus, there is a microprocessor 48 for each ski binding system 10 which is responsible for releasing its own respective boot 12. In common potential injury situations, the release of one boot 12 occurs first and then the release of the other boot 12 naturally follows based on sensors 46 or receiver input.

In an alternative embodiment, both microprocessors 48 are in electrical communication with one another. This may be accomplished by the use of transceivers or other conventional means. When the first microprocessor 48 effects release of its boot from the ski bindings 14, 16, it signals the release to the second microprocessor 48. The second microprocessor 48 in turn effects release of its own boot 12. The transmission of the release signal is almost instantaneous and results in nearly simultaneous release of both boots 12.

In yet another alternative embodiment, a single microprocessor 48 may control the release of both boots 12. The single microprocessor 48 is in electrical communication with all the inputs for each boot 12 and the electromagnets 38, 40 for each boot 12. Such electrical communication may be achieved by transceiver communication or other conventional means. Thus, if one boot 12 is to be released, the microprocessor 48 effects release of both boots 12.

The system 10 of the invention provides engagement of the boot 12 to the ski bindings 14, 16 which is dependent on magnetic fields rather than mechanical means. The elimination of nearly all moving, mechanical parts results in superior reliability, quicker release, and overall performance. Furthermore, release of the bindings 14, 16 is computer controlled which allows for individual customization, quicker response, and a response to a broader range of potential injury situations.

It should be appreciated that the apparatus and methods of the present invention are capable of being incorporated in the form of a variety of embodiments, only a few of which have been illustrated and described above. The described embodiments are to be considered in all respects only as illustrative and not restrictive of the scope of the invention.

What is claimed is:

1. An electric ski binding system for use on a ski which provides magnetic interface to effect binding of a ski boot with the ski binding system, comprising:

a front binding having a front permanent magnet and a front electromagnet;

a rear binding having a rear permanent magnet and a rear electromagnet;

a toe permanent magnet and a heel permanent magnet disposed on the ski boot such that the toe permanent magnet forms an attractive magnetic field with the front permanent magnet and the heel permanent magnet forms an attractive magnetic field with the rear permanent magnet;

a front sensor disposed on the front binding;

a rear sensor disposed on the rear binding; and a processor having a memory and in electrical communication with the front and rear electromagnets and the front and rear sensor, the processor receiving and processing signals from the front and rear sensors to determine if a threshold value is reached, the processor enabling operation of the front and rear electromagnets upon reaching the threshold value to create a repulsive magnetic field between the front electromagnet and the toe permanent magnet and between the rear electromagnet and the heel permanent magnet, and wherein the repulsive magnetic field is sufficient to overcome the attractive magnetic fields and effect release of the ski boot from contact with the front and rear bindings.

2. The electric ski binding system of claim 1 further comprising at least one side sensor wherein the side sensor is in electrical communication with the processor and wherein the processor receives and processes signals from the at least one side sensor to determine if a threshold value is reached.

3. The electric ski binding system of claim 1 wherein the front electromagnet comprises a wire coil disposed around the front permanent magnet and the rear electromagnet comprises a wire coil disposed around the rear permanent magnet.

4. The electric ski binding system of claim 1 further comprising a power source and a switch in electrical communication with the processor and the front and rear electromagnets, wherein operation of the switch is controlled by the processor to effect operation of the front and rear electromagnets.

5. The electric ski binding system of claim 1 further comprising a transmitter disposed on the ski and a receiver disposed on a second ski and in electrical communication with the processor, wherein the transmitter transmits a signal to the receiver, and wherein the receiver relays a communication to the processor upon interruption of the signal to indicate a release situation.

6. The electric ski binding system of claim 1 further comprising a transmitter adapted to dispose on a skier and a receiver adapted to dispose on the skier and in electrical communication with the processor, wherein the transmitter transmits a signal to the receiver, and wherein the receiver relays a communication to the processor upon interruption of the signal to indicate a release situation.

7. The electric ski binding system of claim 1 further comprising a manual release button in electrical communication with the processor wherein operation of the manual release button indicates a release situation.

8. The electric ski binding system of claim 1 further comprising a security sensor and an alarm in electrical communication with the processor wherein the security sensor sends a signal to the processor and the processor activates the alarm in response to the signal.

9. The electric ski binding system of claim 1 wherein the processor is in electrical communication with a second processor in a second electric ski binding system for effecting release of a second ski boot, wherein the processor transmits a signal indicative of a release situation to the second processor to effect release of the second ski boot.

10. The electric ski binding system of claim 1 wherein the processor is programable to adjust weighting factors used in determining the threshold value for a release situation.

11. The electric ski binding system of claim 10 further comprising a temperature sensor in electrical communication with the processor wherein the processor receives and processes signals from the temperature sensor to adjust the threshold value.

12. An electric ski binding system for use on a ski which provides magnetic interface to effect binding and releasable engagement of a ski boot with the ski binding system, comprising:

a front binding having a front permanent magnet and a front electromagnet;

a rear binding having a rear permanent magnet and a rear electromagnet, wherein the rear binding is mounted on a slidable track to allow movement to forward and rearward positions;

a toe permanent magnet and a heel permanent magnet disposed on the ski boot such that the toe permanent magnet forms an attractive magnetic field with the front permanent magnet and the heel permanent magnet forms an attractive magnetic field with the rear permanent magnet, wherein the attractive magnetic field are sufficiently strong to effect binding of the ski boot with the front and rear bindings, and wherein the rear binding is moved to a forward position during binding;

a front sensor disposed on the front binding;

a rear sensor disposed on the rear binding; and a processor having a memory and in electrical communication with the front and rear electromagnets and the front and rear sensor, wherein the processor is programable to adjust weighting factors used in determining a threshold value for a release situation, wherein the processor receives and processes signals from the front and rear sensors to determine if a threshold value is reached, the processor enabling operation of the front and rear electromagnets upon reaching the threshold value to create a repulsive magnetic field between the front electromagnet and the toe permanent magnet and between the rear electromagnet and the heel permanent magnet, wherein the repulsive magnetic field is sufficient to overcome the attractive magnetic fields and effect release of the ski boot from contact with the front and rear bindings, and wherein the rear ski binding is moved to a rearward position during release.

13. The electric ski binding system of claim 12 further comprising at least one side sensor wherein the side sensor is in electrical communication with the processor and wherein the processor receives and processes signals from the at least one side sensor to determine if a threshold value is reached.

14. The electric ski binding system of claim 12 further comprising a power source and a switch in electrical communication with the processor and the front and rear electromagnets, wherein operation of the switch is controlled by the processor to effect operation of the front and rear electromagnets.

15. The electric ski binding system of claim 12 further comprising a transmitter disposed on the ski and a receiver disposed on a second ski and in electrical communication with the processor, wherein the transmitter transmits a signal to the receiver, and wherein the receiver relays a communication to the processor upon interruption of the signal to indicate a release situation.

16. The electric ski binding system of claim 12 further comprising a transmitter adapted to dispose on a skier and a receiver adapted to dispose on the skier and in electrical communication with the processor, wherein the transmitter transmits a signal to the receiver, and wherein the receiver relays a communication to the processor upon interruption of the signal to indicate a release situation.

17. The electric ski binding system of claim 12 further comprising a manual release button in electrical communication with the processor wherein operation of the manual release button indicates a release situation.

18. The electric ski binding system of claim 12 further comprising a security sensor and an alarm in electrical communication with the processor wherein the security sensor sends a signal to the processor and the processor activates the alarm in response to the signal.

19. The electric ski binding system of claim 12 further comprising a temperature sensor in electrical communication with the processor wherein the processor receives and processes signals from the temperature sensor to adjust the threshold value.

20. The electric ski binding system of claim 12 wherein the processor is in electrical communication with a second processor in a second electric ski binding system for effecting release of a second ski boot, wherein the processor transmits a signal indicative of a release situation to the second processor to effect release of the second ski boot.

* * * * *